US008573806B1

(12) United States Patent
Moon

(10) Patent No.: US 8,573,806 B1
(45) Date of Patent: Nov. 5, 2013

(54) LED BULB STRUCTURE

(76) Inventor: Sang Pil Moon, Hong Kong (HK)

( * ) Notice: Subject to any disclaimer, the term of this patent is extended or adjusted under 35 U.S.C. 154(b) by 0 days.

(21) Appl. No.: 13/546,087

(22) Filed: Jul. 11, 2012

(30) Foreign Application Priority Data

Jun. 11, 2012 (CN) ..... 2012 2 0273453 U

(51) Int. Cl.
*F21S 4/00* (2006.01)

(52) U.S. Cl.
USPC ..... 362/249.02; 362/650

(58) Field of Classification Search
USPC ..... 362/249.01, 249.02, 296.01, 299, 310, 362/326–329, 470, 543–546, 650, 800
See application file for complete search history.

(56) References Cited

U.S. PATENT DOCUMENTS 6,183,100 B1 * 2/2001 Suckow et al. ..... 362/35
7,161,313 B2 * 1/2007 Piepgras et al. ..... 315/318
7,645,053 B2 * 1/2010 Machi et al. ..... 362/241
2003/0193807 A1 * 10/2003 Rizkin et al. ..... 362/317
2010/0027281 A1 * 2/2010 Waters et al. ..... 362/470
2012/0241778 A1 * 9/2012 Franck et al. ..... 257/88
2012/0243235 A1 * 9/2012 Gao ..... 362/294

FOREIGN PATENT DOCUMENTS

JP 2005044766 A * 2/2005

* cited by examiner

*Primary Examiner* — Hargobind S Sawhney

(57) ABSTRACT

The present invention relates a LED bulb structure, including: a base, a screw connector which is integrated with the end of the base, and a LED driver; a lamp body is mounted on the base, the top portion of lamp body is a platform on which an PCB substrate is arranged, LED lights are located on the PCB substrate, a lampshade which is engaged with a ring-shape groove of the platform. A reflector assembly includes a reflecting cover support which is inserted in the ring-shape groove located at the edge of the platform, and a reflecting cover which is loaded from the bottom of the reflecting cover support. The reflector assembly further can include a horn-shape reflector which is located above the LED lights inside the lampshade, and has a big small shape with two openings shaped by mean of complete revolving a parabola.

9 Claims, 3 Drawing Sheets

LED BULB STRUCTURE

FIELD OF THE INVENTION

The present invention relates to a LED bulb structure.

BACKGROUND OF THE INVENTION

Conventional LED lamps are low efficiency of heat dissipation, and the irradiance is limited when light of LED lights irradiates downward.

SUMMARY OF THE INVENTION

The object of the present invention is to provide a LED bulb structure through a horn-shape reflector which makes the light of LED reflecting downward above 270 degree, the irradiance will have a larger range and improves the efficiency of light source. Another object of the present invention is to provide LED bulb structure with a plurality of holes are formed on the joint of the lampshade and lamp body, which will efficiently discharge the hot air in the lampshade and extend the life time of LED bulb.

To achieve the above-mentioned objects, the technical solution of the present invention is to provide a LED bulb structure, including: a base, a screw connector which is integrated with the end of the base, and a LED driver which is arranged inside the base; a lamp body is mounted on the base, the top portion of lamp body is a platform on which an PCB substrate is arranged, LED lights are located on the PCB substrate, a lampshade which is engaged with a ring-shape groove of the platform, which characterized in a reflector assembly is located above the PCB substrate and inside the lampshade.

Preferably, the reflector assembly includes a reflecting cover support which is inserted in the ring-shape groove located at the edge of the platform, and a reflecting cover which is loaded from the bottom of the reflecting cover support.

Preferably, the reflecting cover support includes a ring, a plurality of fasteners which are perpendicularly protruded at the bottom of the ring and used for inserting into the ring-shape groove and supporting feet which are connected the fasteners and ring, a horn-shape bracket which an inner edge of the ring is stretched downwards to form, and a plurality of locating slots which are formed at outer edge of the ring and engaged with the reflector fasteners.

Preferably, a hook of the supporting foot is inserted into the ring-shape groove of the platform to lock on a stopper formed by part of the PCB substrate which is outstretched from the top of ring-shape groove.

Preferably, the reflecting cover includes a ring, a horn-shape cover which an inner edge of the ring is stretched downwards to form, and reflector fasteners which are protruded at outer ring edge of the ring and engaged with locating slots of the reflecting cover support.

Preferably, the reflector assembly includes a reflecting cover being engaged with a stopper which is extended from the PCB substrate into the ring-shape groove formed on the edge of the platform; the reflecting cover includes a ring, a plurality of fasteners which are perpendicularly protruded at the bottom of the ring and used for being engaged with the fastener, and supporting feet which are connected the fastener and the ring, a horn-shape cover which is formed by inner ring edge of the ring stretching downward and has a through hole from the bottom up; a hook of the supporting foot is inserted into the ring-shape groove of the platform to lock on a stopper formed by part of the PCB substrate which is outstretched from the top of ring-shape groove.

Preferably, the reflector assembly includes a horn-shape reflector which is located above the LED lights inside the lampshade, and has a big small shape with two openings shaped by mean of complete revolving a parabola; a plurality of holes are formed on the joint of the lampshade and lamp body which the hot air in the lampshade is discharged from; the lampshade includes a upper lampshade and a lower lampshade; and the horn-shape reflector is clipped between the upper and down lampshade.

Preferably, a plurality of holes formed on the joint of the lampshade and the lamp body, which are arranged on the bottom of the lower lampshade or top of the lamp body.

Preferably, a top end of the horn-shaped reflector is inserted in the ring-shape groove at inner face of the upper lampshade and the lower lampshade.

Another technical solution of the present invention is to provide a LED bulb structure, including a base, a screw connector which is integrated with the end of the base, and a LED driver which is arranged inside the base; a lamp body is mounted on the base, the top portion of lamp body is a platform on which an PCB substrate is arranged, LED lights are located on the PCB substrate, a lampshade which is engaged with a ring-shape groove of the platform, a reflector assembly is located above the PCB substrate and inside the lampshade.

The reflector assembly includes a reflecting cover support which is inserted in the ring-shape groove located at the edge of the platform, and a reflecting cover which is loaded from the bottom of the reflecting cover support; thereof, The reflecting cover support includes a ring, a plurality of fasteners which are perpendicularly protruded at the bottom of the ring and used for inserting into the ring-shape groove and supporting feet which are connected the fasteners and ring, a horn-shape bracket which an inner edge of the ring is stretched downwards to form, and a plurality of locating slots which are formed at outer edge of the ring and engaged with the reflector fasteners; a hook of the supporting foot is inserted into the ring-shape groove of the platform to lock on a stopper formed by part of the PCB substrate which is outstretched from the top of ring-shape groove.

The reflecting cover includes a ring, a horn-shape cover which an inner edge of the ring is stretched downwards to form, and reflector fasteners which are protruded at outer ring edge of the ring and engaged with locating slots of the reflecting cover support.

The reflector assembly includes a reflecting cover being engaged with a stopper which is extended from the PCB substrate into the ring-shape groove formed on the edge of the platform; the reflecting cover includes a ring, a plurality of fasteners which are perpendicularly protruded at the bottom of the ring and used for being engaged with the fastener, and supporting feet which are connected the fastener and the ring, a horn-shape cover which is formed by inner ring edge of the ring stretching downward and has a through hole from the bottom up; a hook of the supporting foot is inserted into the ring-shape groove of the platform to lock on a stopper formed by part of the PCB substrate which is outstretched from the top of ring-shape groove.

The reflector assembly includes a horn-shape reflector which is located above the LED lights inside the lampshade, and has a big small shape with two openings shaped by mean of complete revolving a parabola; a plurality of holes are formed on the joint of the lampshade and lamp body which the hot air in the lampshade is discharged from; the lampshade includes a upper lampshade and a lower lampshade;

and the horn-shape reflector is clipped between the upper and down lampshade; a plurality of holes formed on the joint of the lampshade and the lamp body, which are arranged on the bottom of the lower lampshade or top of the lamp body; a top end of the horn-shaped reflector is inserted in the ring-shape groove at inner face of the upper lampshade and the lower lampshade.

Compared to the prior art, the advantages of the present invention as following:

(1) A plurality of holes in the LED bulb structure formed on the joint of the lampshade and the lamp body, which efficiently discharge the hot air in the lampshade, and it is better for the heat dissipation of lampshade.

(2) The LED bulb structure has a wide range of irradiation which is approximately to 320 degree; thereby the utilization of light source will be higher.

(3) The horn-shape reflector makes the LED light reflecting downward the light above 270 degree, and the irradiance will have a wider range which can improve the utilization of light source.

(4) When the reflector and reflecting cover are fixed directly on the PCB substrate, the temperature of PCB substrate is very high, thereby the reflector will change color since the high temperature. The first reflector assembly of the present invention utilizes the fastener on the reflecting cover support which the reflecting cover is fixed on the PCB substrate. It will not only have a beautiful appearance, but also extends the service life of the reflecting cover.

(5) When the reflecting cover is fixed on the lampshade, the lampshade should be delivered to the upper and lower two portions. Since the difficult production process and it does not have a beautiful appearance when the light turned on, the first and second kind of reflector assembly in the present invention by a hook of the supporting foot is inserted into the ring-shape groove of the platform to lock on a stopper formed by part of the PCB substrate which is outstretched from the top of ring-shape groove, which is successfully solved the above problems.

BRIEF DESCRIPTION OF THE DRAWINGS

The accompanying drawings facilitate an understanding of the various embodiments of this invention. In such drawings.

Figure 1:
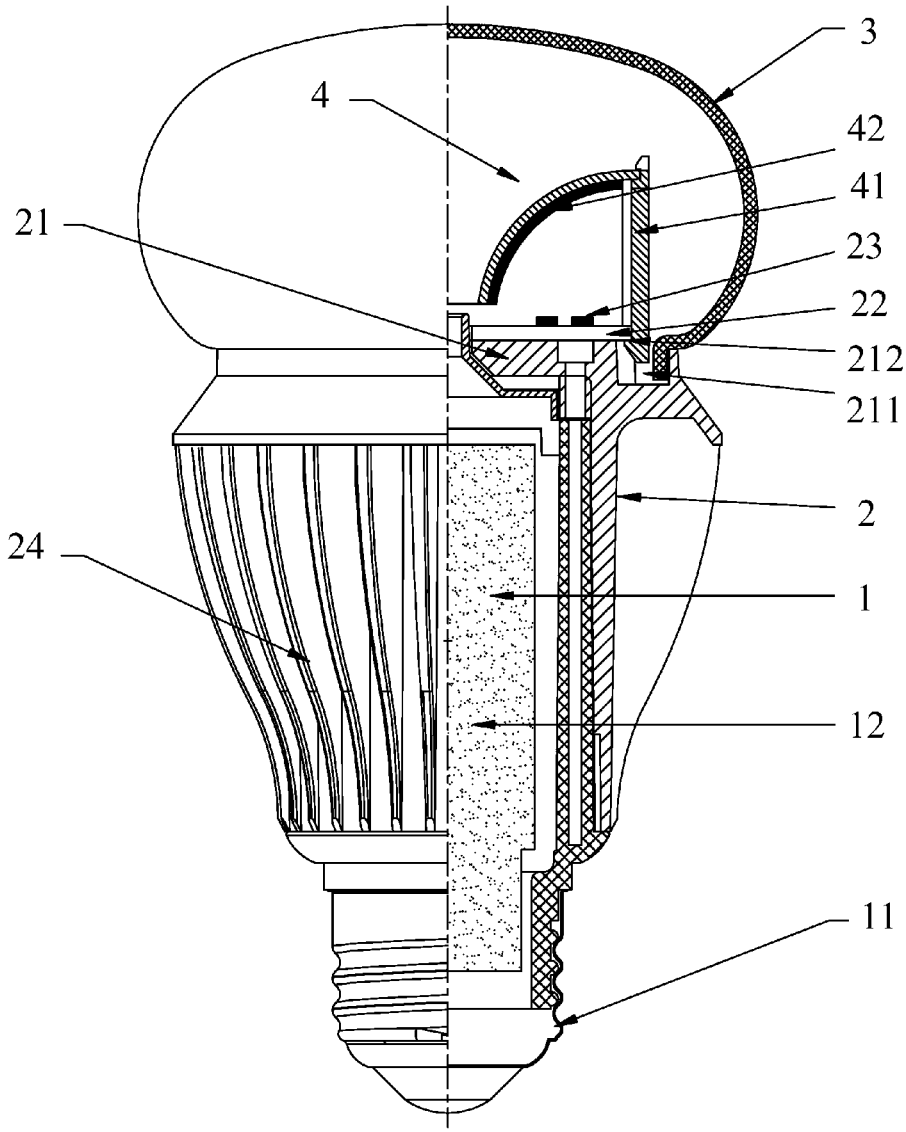
FIG. 1 is a schematic view of the first and second LED bulb structure of the present invention.

Symbols explanation of the main components in drawings: 1—base; 11—screw connection; 12—LED driver; 2—lamp body; 21—platform; 22—PCB substrate; 211—ring-shape embedded slot; 3—lampshade, 4—reflector component; 41—reflecting cover support; 411—ring; 412—supporting foot; 413—buckle; 414—horn-shape bracket; 415—locating slot; 42—reflecting cover; 421—ring; 423—buckle; 424—supporting foot.

DETAILED DESCRIPTION OF ILLUSTRATED EMBODIMENTS

Various preferred embodiments of the invention will now be described with reference to the figures, wherein like reference numerals designate similar parts throughout the various views.

Figure 2:
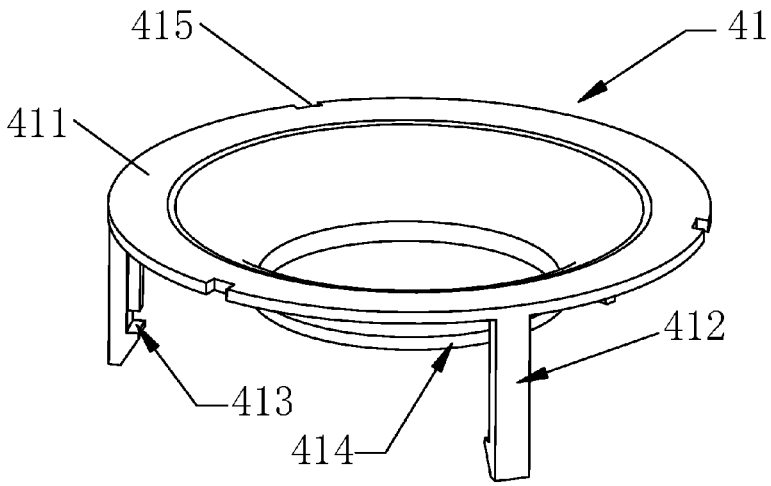
FIG. 2 is a three-dimensional view of the reflecting cover support of LED bulb structure in FIG. 1.
Figure 3:
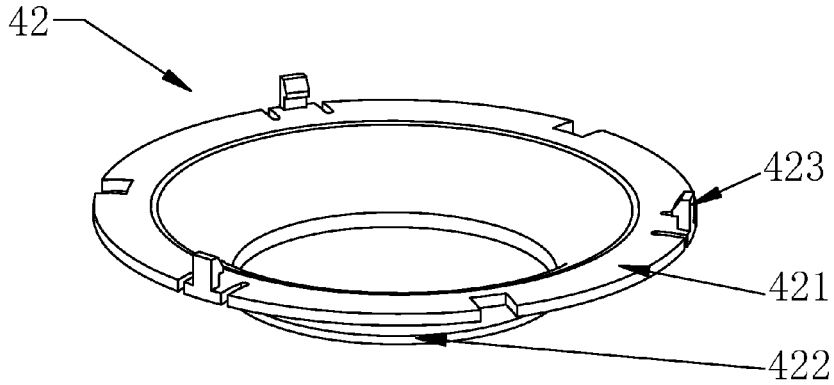
FIG. 3 is a three-dimensional view of the reflecting cover of LED bulb structure in FIG. 1.

FIG. 1 to FIG. 3 present the first embodiment of the present invention.

Referring to FIG. 1, in this embodiment of the present invention, LED bulb structure includes a base 1, a screw connector 11 which is integrated with the end of the base 1, LED driver 12 which is arranged inside the base 1, lamp body 2 is mounted on the base 1, the top portion of lamp body 2 is a platform 21 on which an PCB substrate 22 is arranged, LED light 23 are located on the PCB substrate 22, a lampshade 3 which is engaged with a ring-shape groove 211 of the platform 21. A reflector assembly 4 is located above the PCB substrate 22 and inside the lampshade 3.

Referring to FIG. 1, the reflector assembly 4 includes a reflecting cover support 41 which is inserted in the ring-shape groove 211 located at the edge of the platform 21, and a reflecting cover 42 which is loaded from the bottom of the reflecting cover support 41.

Referring to FIG. 2, the reflecting cover support 41 includes a ring 411, a plurality of fasteners 413 which are perpendicularly protruded at the bottom of the ring 411 and used for inserting into the ring-shape groove 211 and supporting feet 412 which are connected the fasteners 413 and ring 411, a horn-shape bracket 414 which an inner edge of the ring 411 is stretched downwards to form, and a plurality of locating slots 415 which are formed at outer edge of the ring 411 and engaged with the reflector fasteners 423. A hook 212 (As shown in FIG. 1) of the supporting foot is inserted into the ring-shape groove 211 of the platform to lock on a stopper formed by part of the PCB substrate 22 which is outstretched from the top of ring-shape groove 211.

Referring to FIG. 3, the reflecting cover 42 includes a ring 421, a horn-shape cover 422 which an inner edge of the ring 421 is stretched downwards to form, and reflector fasteners 423 which are protruded at outer ring edge of the ring 421 and engaged with locating slots 415 of the reflecting cover support.

Figure 4:
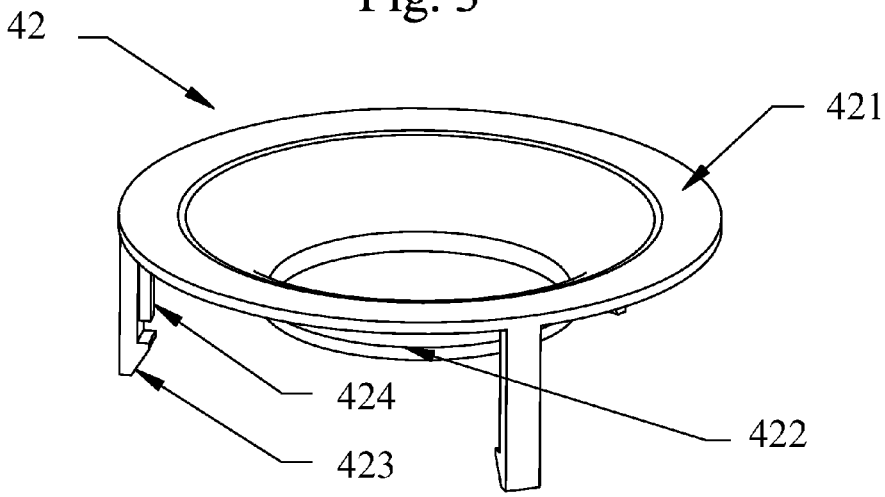
FIG. 4 is a schematic view of the second reflecting cover LED bulb structure of the present invention.

FIG. 1 and FIG. 4 present the second embodiment of the present invention.

Referring to FIG. 4, the difference between the first and second embodiment is the structure of reflector assembly 4. The reflector assembly 4 includes a reflecting cover 42 being engaged with a stopper 212 which is extended from the PCB substrate 22 into the ring-shape groove 211 formed on the edge of the platform 21; the reflecting cover 42 includes a ring 421, a plurality of fasteners 423 which are perpendicularly protruded at the bottom of the ring 421 and used for being engaged with the fastener 423, and supporting feet 424 which are connected the fastener 423 and the ring 421, a horn-shape cover 422 which is formed by inner ring edge of the ring stretching downward and has a through hole from the bottom up; a hook 212 (As shown in FIG. 1) of the supporting foot 424 is inserted into the ring-shape groove 211 of the platform to lock on a stopper formed by part of the PCB substrate 22 which is outstretched from the top of ring-shape groove 211.

Figure 5:
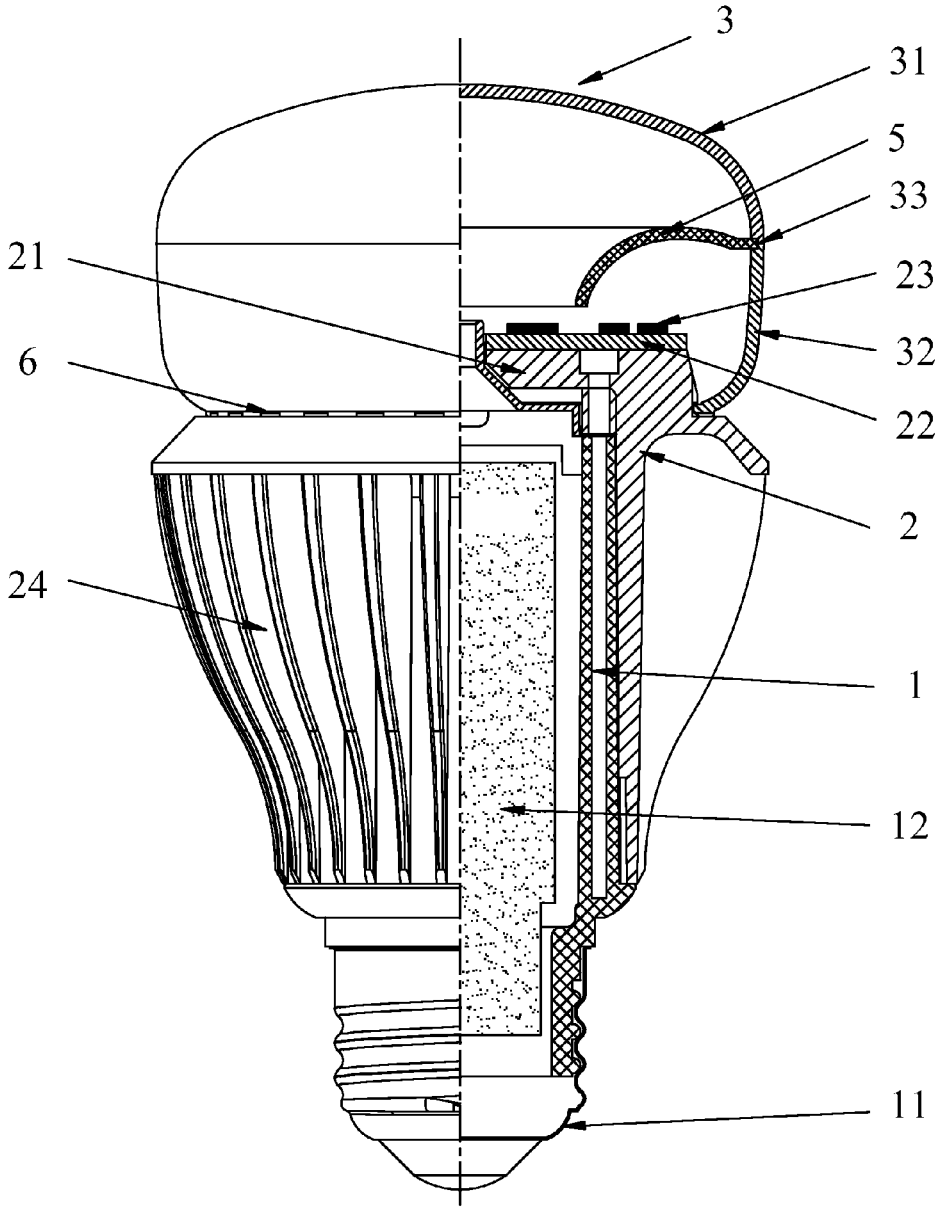
FIG. 5 is a schematic view of the third LED bulb structure of the present invention.

FIG. 5 presents the second embodiment of the present invention.

Referring to FIG. 5, in this embodiment, LED bulb structure includes a base 1, a screw connector 11 which is integrated with the end of the base 1, and a LED driver 12 which is arranged inside the base 1; a lamp body 2 is mounted on the base 1, the top portion of lamp body 2 is a platform 21 on which an PCB substrate 22 is arranged, LED lights 23 are located on the PCB substrate 22, a lampshade 3 which is engaged with a ring-shape groove 211 of the platform. A horn-shape reflector 5 which is located above the LED lights 23 inside the lampshade 3, and has a big small shape with two openings shaped by mean of complete revolving a parabola;

a plurality of holes 6 are formed on the joint of the lower lampshade 32 and lamp body 2 which the hot air in the lampshade 3 is discharged from; the lampshade 3 includes a upper lampshade 31 and a lower lampshade 32; and the horn-shape reflector 5 is clipped between the upper lampshade 31 and the down lampshade 32. The housing of lamp body 2 is arranged on hot sinks 24.

In this embodiment, a plurality of holes 6 formed on the joint of the lampshade 3 and the lamp body 2, which are arranged on the bottom of the lower lampshade 32 or top of the lamp body 2.

In this embodiment, a top end of the horn-shaped reflector 5 is inserted in the ring-shape groove 33 at inner face of the upper lampshade 31 and the lower lampshade 32.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A LED bulb structure, comprising: a base, a screw connector which is integrated with the end of the base, and a LED driver which is arranged inside the base; a lamp body is mounted on the base, the top portion of lamp body is a platform on which an PCB substrate is arranged, LED lights are located on the PCB substrate, a lampshade which is engaged with a ring-shape groove of the platform, wherein a reflector assembly is located above the PCB substrate and inside the lampshade; the reflector assembly comprises a reflecting cover support which is inserted in the ring-shape groove located at the edge of the platform, and a reflecting cover which is loaded from the bottom of the reflecting cover support.

2. A LED bulb structure according to claim 1, wherein the reflecting cover support comprises a ring, a plurality of fasteners which are perpendicularly protruded at the bottom of the ring and used for inserting into the ring-shape groove and supporting feet which are connected the fasteners and ring, a horn-shape bracket which an inner edge of the ring is stretched downwards to form and a plurality of locating slots which are formed at outer edge of the ring and engaged with the reflector fasteners.

3. A LED bulb structure according to claim 2, wherein a hook of the supporting foot is inserted into the ring-shape groove of the platform to lock on a stopper formed by part of the PCB substrate which is outstretched from the top of ring-shape groove.

4. A LED bulb structure according to claim 1, wherein the reflecting cover comprises a ring, a horn-shape cover which an inner edge of the ring is stretched downwards to form and reflector fasteners which are protruded at outer ring edge of the ring and engaged with locating slots of the reflecting cover support.

5. A LED bulb structure according to claim 1, wherein the reflector assembly comprises a reflecting cover being engaged with a stopper which is extended from the PCB substrate into the ring-shape groove formed on the edge of the platform; the reflecting cover comprises a ring, a plurality of fasteners which are perpendicularly protruded at the bottom of the ring and used for being engaged with the fastener, and supporting foots which are connected the fastener and the ring, a horn-shape cover which is formed by inner ring edge of the ring stretching downward and has a through hole from the bottom up; a hook of the supporting foot is inserted into the ring-shape groove of the platform to lock on a stopper formed by part of the PCB substrate which is outstretched from the top of ring-shape groove.

6. A LED bulb structure according to claim 1, wherein the reflector assembly comprises a horn-shape reflector which is located above the LED lights inside the lampshade, and has a big small shape with two openings shaped by mean of complete revolving a parabola; a plurality of holes are formed on the joint of the lampshade and lamp body which the hot air in the lampshade is discharged from; the lampshade comprises a upper lampshade and a lower lampshade; and the horn-shape reflector is clipped between the upper and down lampshade.

7. A LED bulb structure according to claim 6, wherein a plurality of holes formed on the joint of the lampshade and the lamp body, which are arranged on the bottom of the lower lampshade or top of the lamp body.

8. A LED bulb structure according to claim 6, wherein a top end of the horn-shaped reflector is inserted in the ring-shape groove at inner face of the upper lampshade and the lower lampshade.

9. A LED bulb structure, comprising: a base, a screw connector which is integrated with the end of the base, and a LED driver which is arranged inside the base; a lamp body is mounted on the base, the top portion of lamp body is a platform on which an PCB substrate is arranged, LED lights are located on the PCB substrate, a lampshade which is engaged with a ring-shape groove of the platform, wherein a reflector assembly is located above the PCB substrate and inside the lampshade; the reflector assembly can be chosen from one of the following three structures:

the reflector assembly comprises a reflecting cover support which is inserted in the ring-shape groove located at the edge of the platform, and a reflecting cover which is loaded from the bottom of the reflecting cover support; thereof, the reflecting cover support comprises a ring, a plurality of fasteners which are perpendicularly protruded at the bottom of the ring and used for inserting into the ring-shape groove and supporting feet which are connected the fasteners and ring, a horn-shape bracket which an inner edge of the ring is stretched downwards to form and a plurality of locating slots which are formed at outer edge of the ring and engaged with the reflector fasteners; a hook of the supporting foot is inserted into the ring-shape groove of the platform to lock on a stopper formed by part of the PCB substrate which is outstretched from the top of ring-shape groove;

the reflecting cover comprises a ring, a horn-shape cover which an inner edge of the ring is stretched downwards to form and reflector fasteners which are protruded at outer ring edge of the ring and engaged with locating slots of the reflecting cover support; or the reflector assembly comprises a reflecting cover being engaged with a stopper which is extended from the PCB substrate into the ring-shape groove formed on the edge of the platform;

the reflecting cover comprises a ring, a plurality of fasteners which are perpendicularly protruded at the bottom of the ring and used for being engaged with the fastener, and supporting foots which are connected the fastener and the ring, a horn-shape cover which is formed by inner ring edge of the ring stretching downward and has a through hole from the bottom up; a hook of the supporting foot is inserted into the ring-shape groove of the platform to lock on a stopper formed by part of the PCB substrate which is outstretched from the top of ring-shape groove; or the reflector assembly comprises a horn-shape reflector which is located above the LED lights inside the lampshade, and has a big small shape with two openings shaped by mean of complete revolving a parabola; a plurality of holes are formed on the joint of the lampshade and lamp body which the hot air in the lampshade is discharged from; the lampshade comprises a upper lampshade and a lower lampshade; and the horn-shape reflector is clipped between the upper and down lampshade; a plurality of holes formed on the joint of the lampshade and the lamp body, which are arranged on the bottom of the lower lampshade or top of the lamp body; a top end of the horn-shaped reflector is inserted in the ring-shape groove at inner face of the upper lampshade and the lower lampshade.

* * * * *